US006296113B1

(12) United States Patent
Bartels et al.

(10) Patent No.: US 6,296,113 B1
(45) Date of Patent: Oct. 2, 2001

(54) HINGE LID CIGARETTE PACKETS

(75) Inventors: Jochen Bartels, Ahrensburg; Jürgen Fiebiger, Igensdorf; Thomas Weinhold, München, all of (DE)

(73) Assignee: British American Tobacco (Investments) LTD, London (GB)

( * ) Notice: Subject to any disclaimer, the term of this patent is extended or adjusted under 35 U.S.C. 154(b) by 0 days.

(21) Appl. No.: 09/622,912

(22) PCT Filed: Mar. 5, 1999

(86) PCT No.: PCT/GB99/00649

§ 371 Date: Sep. 14, 2000

§ 102(e) Date: Sep. 14, 2000

(87) PCT Pub. No.: WO99/44918

PCT Pub. Date: Sep. 10, 1999

(30) Foreign Application Priority Data

Mar. 7, 1998 (DE) ..... 198 09 086

(51) Int. Cl.[7] ..... B65D 85/10

(52) U.S. Cl. ..... 206/261; 206/268; 229/120.03

(58) Field of Search ..... 206/256, 259, 206/261, 265, 268, 271, 273; 229/120.03, 120.32, 121, 160.1

(56) References Cited

U.S. PATENT DOCUMENTS

| | | | | |
|---|---|---|---|---|
| 2,983,424 | * | 5/1961 | Glass | 206/256 |
| 2,994,465 | * | 8/1961 | Kauffeld | 229/120.03 |
| 3,007,623 | * | 11/1961 | Clemens | 229/120.03 |
| 3,039,671 | * | 6/1962 | Chiamardas | 206/268 |
| 3,092,301 | * | 6/1963 | Selle | 229/120.03 |
| 5,074,412 | | 12/1991 | White . | |
| 5,467,872 | | 11/1995 | Minarelli et al. . | |
| 5,513,748 | | 5/1996 | Focke et al. . | |

FOREIGN PATENT DOCUMENTS

| | | |
|---|---|---|
| 4024972 A1 | 2/1991 | (DE) . |
| 0 380 898 A1 | 8/1990 | (EP) . |
| 0 625 469 A2 | 4/1994 | (EP) . |
| 0 769 457 A1 | 4/1997 | (EP) . |

* cited by examiner

*Primary Examiner*—Luan K. Bui
(74) *Attorney, Agent, or Firm*—Jones, Tullar & Cooper

(57) ABSTRACT

A hinge lid cigarette packet has an upper lid and a lower lid. The packet is constructed from a blank which is of a configuration which is symmetrical about the longitudinal centerline thereof. The upper lid is formed, in conventional fashion, of specifically lid panels of the blank, whereas the lower lid is formed of portions of what in a conventional single hinge lid packet are body panels. In order for the second lid to be moved from its closed position on the first opening thereof, front and side panels of the lid are separated at lines of weakening from bounding body panels.

20 Claims, 5 Drawing Sheets

HINGE LID CIGARETTE PACKETS

BACKGROUND OF THE INVENTION

The subject invention relates to hinge lid cigarette packets comprising first and second, opposing lids.

In the tobacco industry so-called hinge lid packets are widely used for the packaging of cigarettes. These packets comprise a body, essentially in the form of a rectangular parallelepiped, and a lid hingedly secured at the upper end of the body. It is usual for such packets to further comprise a neck part which projects upwardly from the front and side walls of the body such as to be received within the lid when the lid is in the closed position thereof.

There have also become known hinge lid packets comprising two lids, these being respectively disposed at the upper and lower ends of the body.

An example of a hinge lid cigarette packet comprising two lids is disclosed in EP 380 898. The blank for this packet is of a generally T configuration with the "stem" of the T comprising a minor portion of the blank. At either end of the major portion of the blank (the "crossing" of the T) are disposed those panels which provide the lids in the erected packet. In the erected packet one side wall of the body is comprised of two, superimposed panels, i.e. it is of double thickness, whereas the other side wall of the body is provided by only one panel, i.e. it is of single thickness. By contrast, both side walls of each of the lids are of double thickness. Thus the erected pack is of an unattractive inherent asymmetry. Furthermore, the T configured blank is, in comparison to the generally rectangular blank of a conventional hinged lid packet, wasteful of cartonboard.

Disclosed in EP 625 469 is a packet blank for a two lidded hinge lid packet intended for holding special cigarettes. Although this packet can be produced from a packet blank which is generally of a rectangular configuration, the erected packet is not strictly symmetrical in construction since, as with the packet of EP 380 898, one of the body side walls is of single thickness and the other is of double thickness.

Known from U.S Pat. No 5,074,412 is a cigarette packed with upper and lower hinged lids and comprising a wall which serves to divide the interior of the body into upper and lower chambers.

SUMMARY OF THE INVENTION

An object of the subject invention is to provide a hinge lid cigarette packet with two opposed hinged lids, disposed at the top and bottom ends respectively of the erected packet, the blank of which packet is of a very simple configuration which differs only slightly from conventional blanks for conventional hinge lid cigarette packets.

The subject invention provides a hinge lid cigarette packet comprising a body and first and second hinged lids disposed at respective opposed ends of the packet, said body together with said lids being formed from a unitary blank, which blank is of a configuration symmetrical about a lengthwise centreline of the blank, front and side walls of said first lid being provided by panels of said blank which in said blank are other than in abutting attachment to body panels of said blank, whereas front and side walls of said second lid are provided by panels which in said blank abut and are attached along lines of weakness to body panels of said blank, the first opening of said second lid being permitted by separation of the respective lid and body panels along said lines of weakness.

The subject invention renders possible, for the purpose of producing a hinge lid packet with two lids, the use of punched blanks which in the outer configuration thereof scarcely differ, if at all, from a blank of a conventional hinge lid packet. Consequently, the packaging machines which are normally used can continue to be used for handling the packet blanks according to the invention without the need for major modifications. The hinge lid packet produced is not obviously different in appearance from a conventional hinge lid packet. The second lid section is only prepared by means of appropriate lines of weakening of the packet blank, its realisation and use as an additional lid being effected only by the user, for example through the breaking of residual joints of special punched lines of the packet blank.

Furthermore, the invention enables hinge lid packets with two lids to be fashioned in a very economical manner.

The hinge of the second lid can be located on either the front or back of the packet. If the hinge is located on the front of the packet, then to the purchaser the front and the back of the packet have the same appearance, so that it is only upon closer inspection that it is apparent to the purchaser that the packet has two lids.

It is preferable for a neck insert to be assigned to each of the two lids respectively, but it is also possible for the neck inserts to be fashioned as a common, unitary insert, particularly when both hinges for the lids are located on the back of the packet.

The neck insert assigned to a lid preferably comprises a cutout, laterally offset relative to the axis of symmetry of the packet, as a region for the removal of cigarettes. The remaining region of the neck insert may comprise a fold-over barrier region. This enables the purchaser to remove the cigarettes via the neck insert cutout, while the cigarettes covered by the barrier region remain inaccessible, or substantially inaccessible. These latter cigarettes can be removed from the other end of the packet, the neck insert at that end comprising a cutout which is assigned to these cigarettes. This improves the assignment of cigarette types to respective sides of the packet, it being possible to further enhance the assignment by paper wrapping the two cigarette types as two separate blocks.

BRIEF DESCRIPTION OF THE DRAWINGS

In order that the subject invention may be clearly understood and readily carried into effect, reference is now made, by way of example, to the accompanying drawings, in which.

Figure 1:
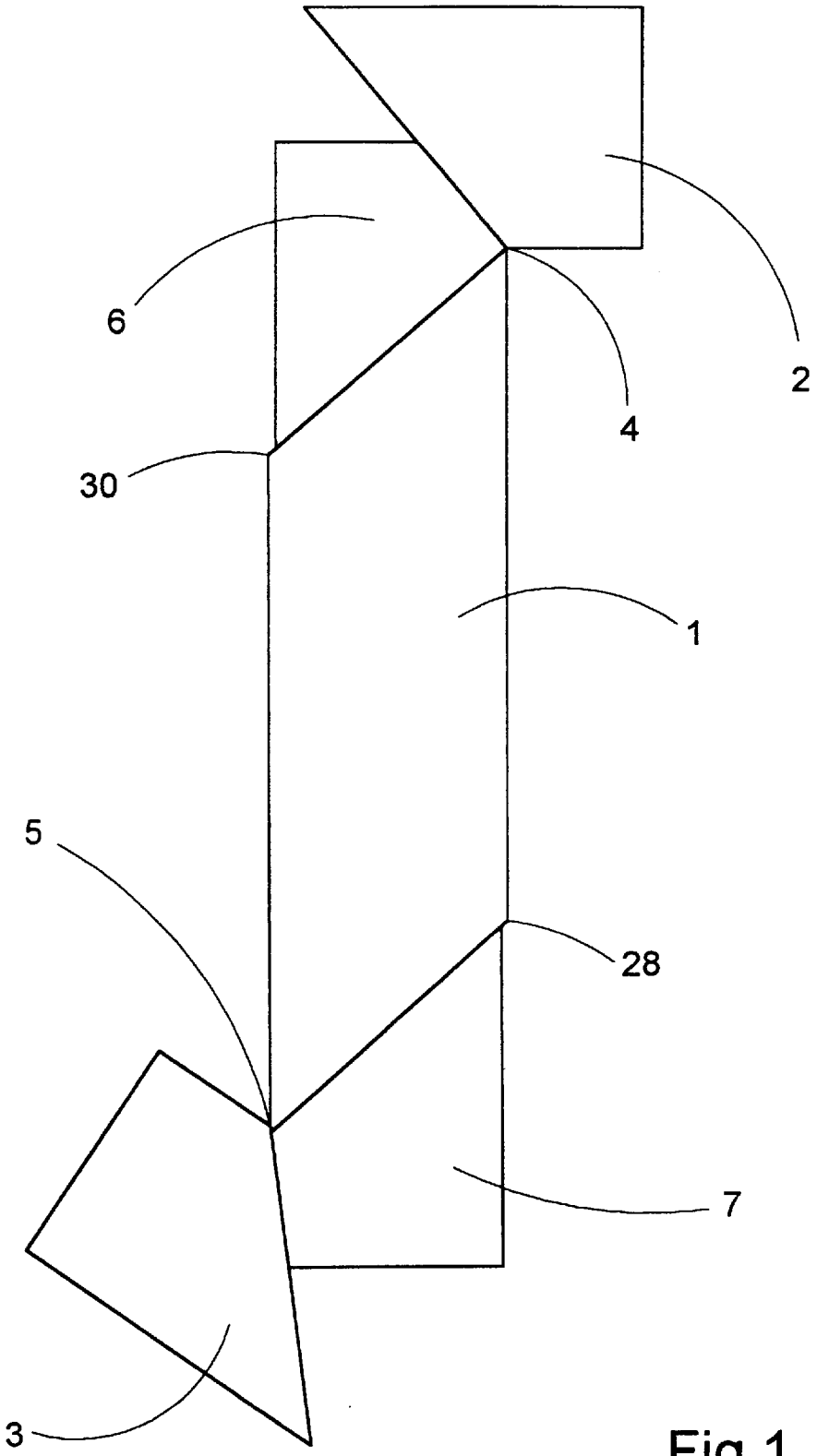
FIG. 1 shows a side view of a hinge lid cigarette packet with two lids disposed respectively at the upper and the lower ends of the packet.

N.B. In respect of FIGS. 2 and 4, pairs of features of the blanks which are "mirror images" one of the other are assigned the same reference numeral although, to avoid an undue multitude of reference numerals, the common reference numeral for a pair of "mirror image" features appears in the figures only in respect of one of the features of the pair.

DETAILED DESCRIPTION OF THE PREFERRED EMBODIMENTS

The cigarette packet depicted in FIG. 1 comprises a body 1, a first, upper lid 2 and a second, lower lid 3. Reference numerals 4 and 5 designate the respective hinge lines of the lids 2 and 3. In FIG. 1 each of the lids 2, 3 is shown in an open position.

The packet of FIG. 1 further comprises upper and lower neck inserts 6 and 7.

As will be readily apparent to those skilled in the art, when each of the lids 2, 3 is in the closed position thereof, the packet is exteriorly a rectangular parallelepiped in form.

The blank (FIG. 2) for fashioning the cigarette packet of FIG. 1 is configured symmetrically in the packaging machine feed direction, the outer form of the blank corresponding to that of a blank of a conventional hinge lid cigarette packet. The blank comprises an upper portion from which is fashioned the upper lid 2. A panel 8 forms the front of the lid 2, while a panel 9 forms the back of the lid 2. Panels 11, 12 provide lid inner flaps which are folded inwards and are glued to the inner face of the top (13) of the lid 2 and to the inner faces of the sides 10 of the lid 2 respectively. For this purpose there are provided cut lines 15 (shown in bold) which separate the panels 10 and the lid top panel 13 from the panel flaps 11. A panel 38, which serves as a reinforcement for the front edge of the lid 2, is folded over by means of a fold line 14. The panels 10, 11, 12 are folded on fold line 37. In the erected packet, the fold lines designated 16 form the upper edges of the sides of the lid 2.

To prevent problems in closing the lid 2, cutouts 18 are provided between each body side panel 19 and the associated lid inner flap 12.

The back of the body 1 is formed by panels 17 and 24, the panel 17 being divided from the panel 24 by a punched line 28. The line 28 runs transversely over the back of the body 1 and also divides the body side panels 19 from body side panels 20. The punched line 28 is essentially a line of cut which, however, comprises residual joints, provided by uncut webs of material, for the purpose of initially holding together the panels extending at each side of the line 28.

In respect of the packet as first erected, a panel 25 provides the packet base and panels 26 and 27 provide the front of the packet body. The hinge line 5 provides the boundary between the panels 26 and 27. Outer body side panels 22 and 23 are divided one from the other by a punched line 33, which line 33 comprises residual joints. Inner flaps 21, which are separated by cutting lines 29 from the panels 22 and the panel 25 and are joined to the panels 20 by fold line 32, are folded inwards when the packet is folded up and glued, being glued to the base panel 25.

Figure 2:
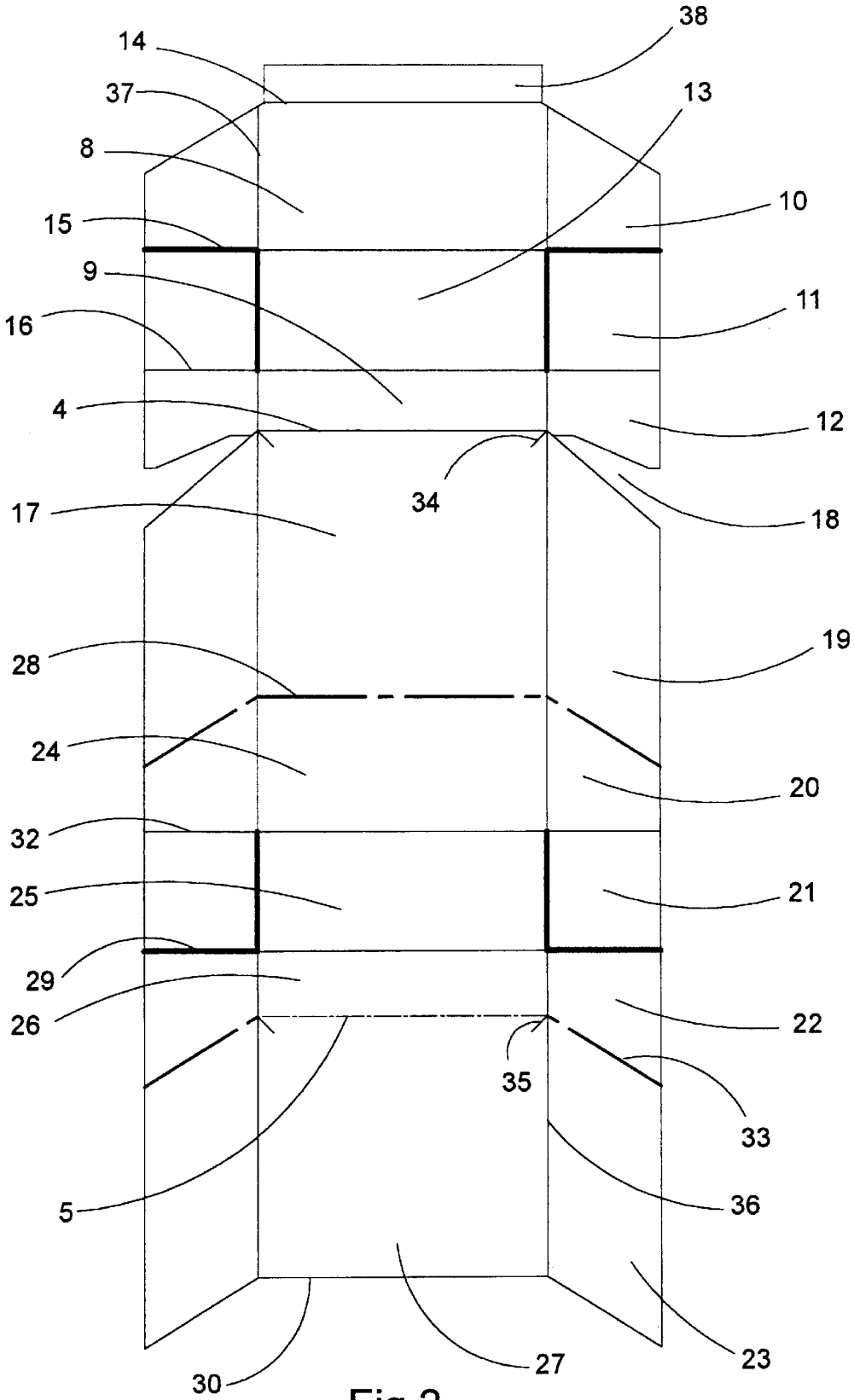
FIG. 2 shows a blank for fashioning the packet of FIG. 1.

The cigarette packet is fashioned from the blank of FIG. 2 by being folded up and glued in known manner. In the vertical direction of the upright packet, this folding is wholly symmetrical owing to the fact that the packet blank is configured absolutely symmetrically in relation to the longitudinal centreline thereof.

Whereas the first, upper lid 2 of the finished packet hinges from the closed to an open position in the normal manner, the second, lower lid 3 is initially still rigidly joined to the body 1 at the punched lines 28 and 33 by means of the residual material joints of these lines. The purchaser of a packet can, however, open the second lid 3 by causing breakage of the residual material joints of the punched lines 28 and 33.

The line 5 remains as a fold line and forms the hinge for the second lid 3. The hinging action is aided by the fact that the line 5 is formed as a scored line, as is the hinge line 4. In order to prevent edge damage, the hinge lines 4 and 5 are provided with inclined end incisions 34 and 35 respectively.

When the upper lid 2 is closed, the fold line 14 of the finished packet abuts on upper edge 30 of body front panel 27, whereas the upper edge of the panel 24 of the lower lid 3 abuts, when lid 3 is closed, on the lower edge of the body back panel 17 at the location of the punched line 28.

Although the upper edge of the panel 24 lacks a reinforcement corresponding to that provided by the panel 38 to the lower edge of the panel 8, this is not disadvantageous since the cigarette packet is in any case a special packet in which preferably only half the number of cigarettes of a conventional hinge lid packet is assigned to each of the lids, so that the frequency of opening each of the lids is half that respecting the single lid of a conventional packet.

Figure 3:
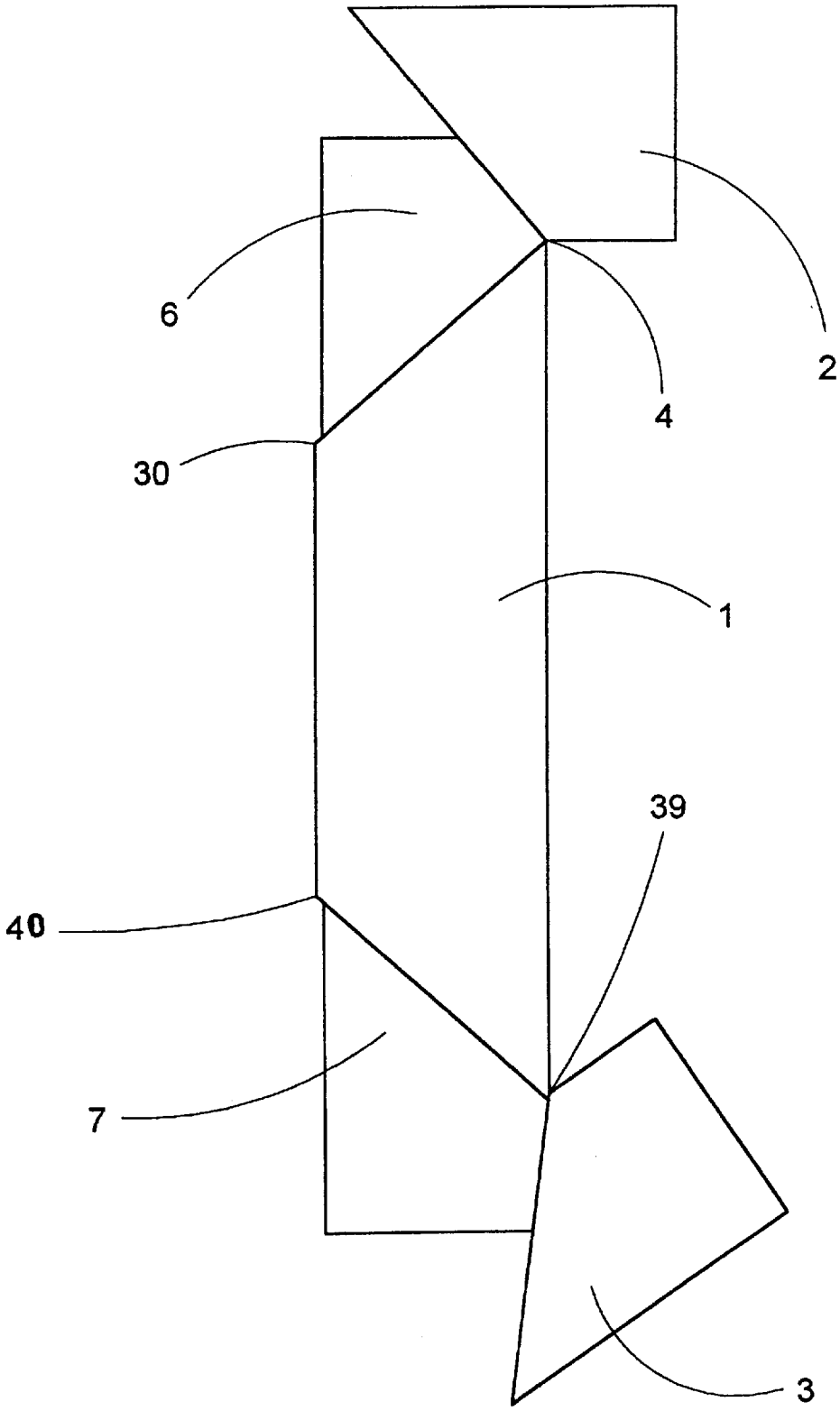
FIG. 3 shows a side view of a hinge lid cigarette packet differing somewhat from the packet of FIG. 1.

Whereas FIG. 1 shows a cigarette packet with two lids the hinges of which are disposed opposite one another on the front and back faces of the packet, FIG. 3 shows a cigarette packet with two lids the hinges of which are disposed on the same side, i.e. the back, of the packet. In this latter case the second, lower lid 3 is joined to the packet body 1 by means of a hinge 39. When the packet is closed, the upper front edge of the lid 3 abuts on the edge 40 of the packet body 1.

Figure 4:
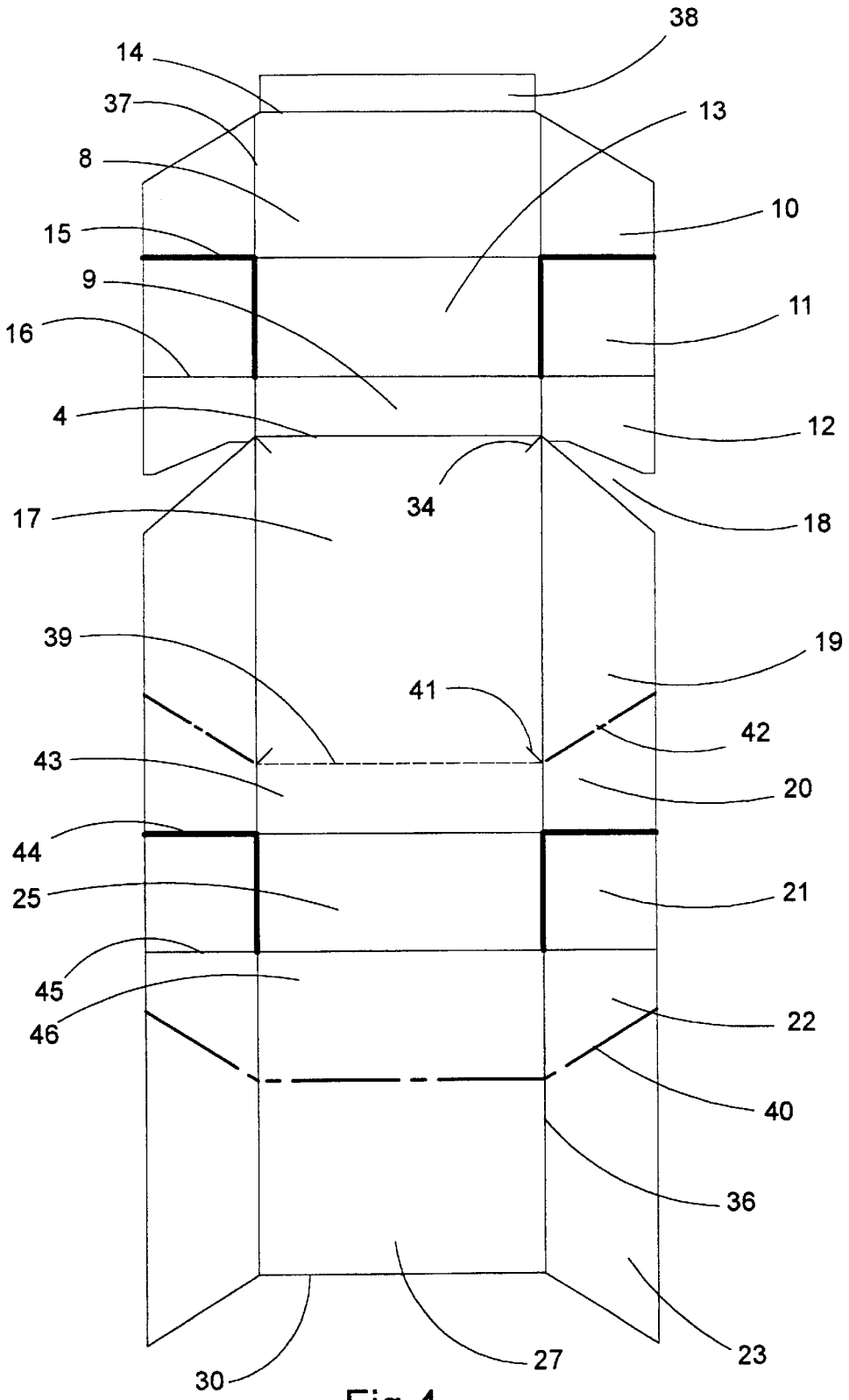
FIG. 4 shows a blank for the packet of FIG. 3.

The packet blank according to FIG. 4, i.e. that for the packet of FIG. 3, is essentially the same as the packet blank of FIG. 2 with the difference that the fold and punched lines 39, 40, 42 have a different orientation, as does cut line 44 in comparison with cut line 29 of the FIG. 2 blank. In this case, the line 39 forms the hinge of the lower lid 3 and divides panels 17 and 43. The panel 43 provides the back of the lower lid 3 in the finished packet. The front of the lid 3 is formed by panel 46, which is divided from the panel 27 by the punched line 40.

Incisions 34, 41 are provided in respect of the lines 4 and 39 respectively.

In the packet formed from the FIG. 4 blank the fold line 45 forms the lower front edge of the lower lid 3.

Figure 5:
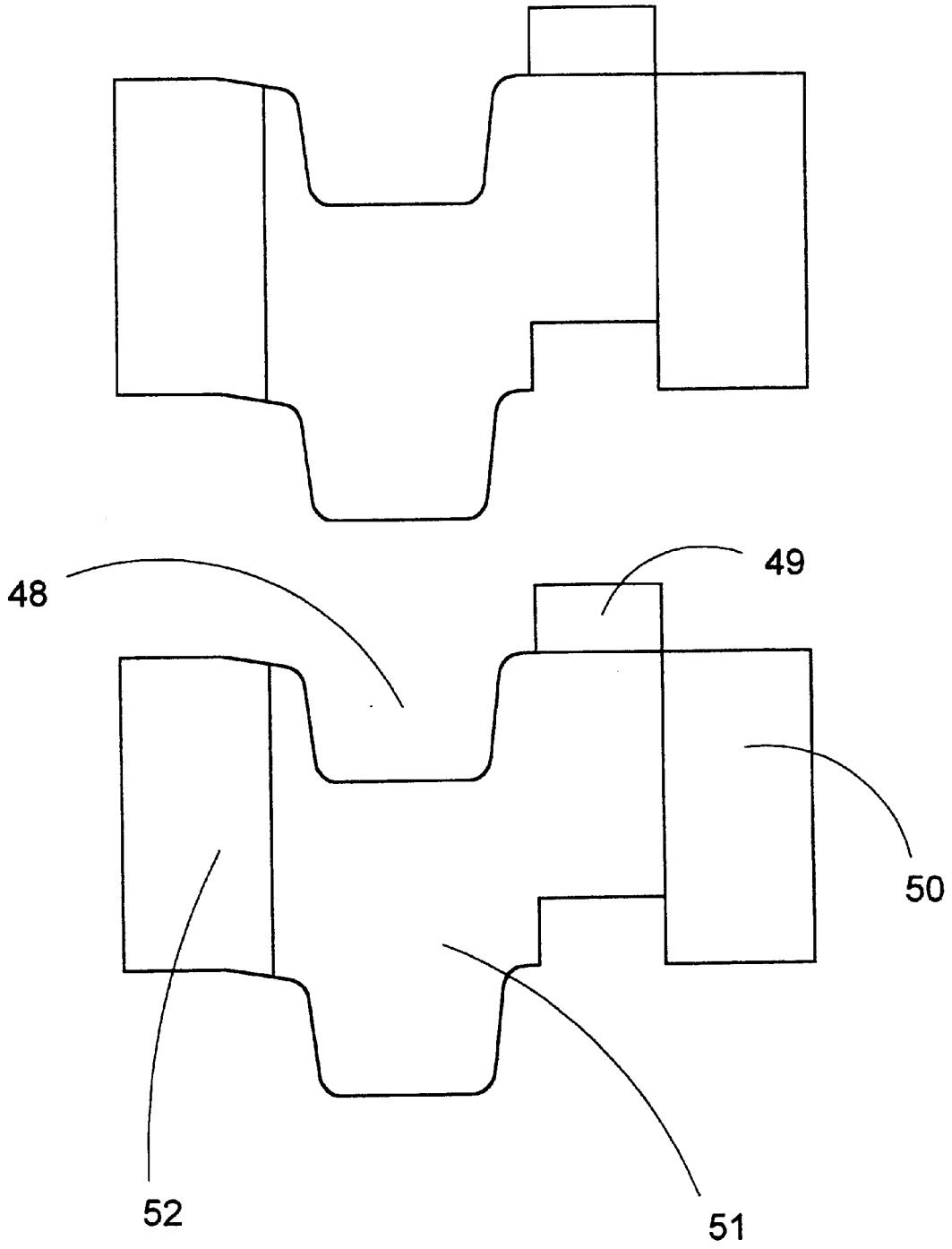
FIG. 5 shows two neck insert blanks.

The form of neck insert blank shown in FIG. 5 can be used for either of the just described cigarette packets, i.e. to provide the neck inserts 6 and 7 of FIGS. 1 and 3. As is conventional with the neck inserts of hinge lid cigarette packets, the inserts 6, 7 are received in and are secured to the packet body 1 and extend outwardly of the body 1, the portions of the respective inserts 6, 7 outwith the body 1 being received respectively in the lids 2, 3 when the lids 2, 3 are in the closed positions thereof.

Each of the neck inserts comprises a middle panel 51 and side panels 50, 52. Those portions of the side panels 50, 52 which extend within body 1 of a packet lie against inner surfaces of respective side wall panels of the body 1. To facilitate the removal of a cigarette, a removal cutout 48 is provided in the panel 51, which cutout is offset in relation to the longitudinal line of symmetry of the cigarette packet. To the other side of the neck insert from the cutout 48 the insert comprises a barrier flap 49 which is folded over in order to make it clear to the consumer that cigarettes should be removed solely via the cutout 48, while the cigarettes covered by the barrier flap 49 should be removed from the other end of the packet, disposition of the cutout 48 being reversed at that end in relation to the line of symmetry of the packet.

FIG. 5 shows two neck insert blanks arranged one above the other in order to demonstrate that edge regions thereof are matched to one another in such a way that the inserts can be stamped from a continuous strip of cartonboard without waste.

Although FIG. 5 shows a neck insert which is assigned to only one lid in each case, the invention also includes single-piece neck inserts which have a configuration on one end which is assigned to the first lid and on the other end are configured for assignment to the second lid. Following its insertion in the packet, such a neck insert then forms the respective neck insert regions assigned to the two lids.

What is claimed is:

1. A hinge lid cigarette packet comprising:

a body; and first and second hinged lids disposed at respective opposed ends of the body, said body together with said lids being formed from a unitary blank, which blank is of a configuration symmetrical about a lengthwise centerline of the blank;

wherein front and side walls of said first lid are provided by panels of said blank which in said blank are other than in abutting attachment to body panels of said blank, whereas front and side walls of said second lid are provided by panels which in said blank abut and are attached along lines of weakness to body panels of said blank, whereby the first opening of said second lid is permitted by separation of the respective lid and body panels along said lines of weakness.

2. A packet according to claim 1 in which the hinge line of said first lid extends transversely at the back of said packet and the hinge line of said second lid extends transversely at the front of said packet.

3. A packet according to claim 1 wherein the respective hinge lines of said first and second lids both extend transversely at the back of said packet.

4. A packet according to claim 1 further comprising first and second neck inserts each received in said body, said first insert extending from said body and being received into said first lid when said first lid is in the closed position thereof, and said second insert extending from said body and being received into said second lid when said second lid is in the closed position thereof.

5. A packet according to claim 2 further comprising first and second neck inserts, each received in said body, said first insert extending from said body and being received into said first lid when said first lid is in the closed position thereof, and said second insert extending from said body and being received into said second lid when said second lid is in the closed position thereof.

6. A packet according to claim 3 further comprising first and second neck inserts, each received in said body, said first insert extending from said body and being received into said first lid when said first lid is in the closed position thereof, and said second insert extending from said body and being received into said second lid when said second lid is in the closed position thereof.

7. A packet according to claim 4 in which the portion of each of said inserts which extends from said body comprises a cigarette access cutout, the cutout of said first insert being located to one side of said packet and the cutout of said second insert being located to the other side of the packet.

8. A packet according to claim 7 in which each of said inserts comprises a barrier means to the side of said packet opposite that side at which said cutout is located.

9. A packet according to claim 8 in which said first and second inserts are unitary, one with the other.

10. A cigarette packet formed from a unitary blank of symmetrical configuration, said packet comprising:

a body; and first and second lids hingedly attached at respective opposed ends of the body, such that when said lids are closed, said packet is in the form of a rectangular parallelepiped;

wherein said body together with said lids are formed from a unitary blank, which blank is of a configuration symmetrical about a lengthwise centerline of the blank;

wherein front and side walls of said first lid are provided by panels of said blank which in said blank are other than in abutting attachment to body panels of said blank, whereas front and side walls of said second lid are provided by panels which in said blank abut and are attached along lines of weakness to body panels of said blank, whereby the initial opening of said second lid is accomplished by separation of the respective lid and body panels along said lines of weakness.

11. A packet according to claim 10 in which the hinge line of said first lid extends transversely at the back of said packet and the hinge line of said second lid extends transversely at the front of said packet.

12. A packet according to claim 10 wherein the respective hinge lines of said first and second lids both extend transversely at the back of said packet.

13. A packet according to claim 10 further comprising first and second neck inserts., each received in said body, said first insert extending from said body and being received into said first lid when said first lid is in the closed position thereof, and said second insert extending from said body and being received into said second lid when said second lid is in the closed position thereof.

14. A packet according to claim 12 further comprising first and second neck inserts, each received in said body, said first insert extending from said body and being received into said first lid when said first lid is in the closed position thereof, and said second insert extending from said body and being received into said second lid when said second lid is in the closed position thereof.

15. A packet according to claim 13 in which the portion of each of said inserts which extends from said body comprises a cigarette access cutout, the cutout of said first insert being located to one side of said packet and the cutout of said second insert being located to the other side of the packet.

16. A packet according to claim 15 in which each of said inserts comprises a barrier means to the side of said packet opposite that side at which said cutout is located.

17. A packet according to claim 16 in which said first and second inserts are unitary, one with the other.

18. A cigarette packet formed from a unitary blank of symmetrical configuration, said packet comprising:

a body; and first and second lids hingedly attached at respective opposed ends of the body, such that when said lids are closed, said packet is in the form of a rectangular parallelepiped;

wherein said body together with said lids are formed from a unitary blank, which blank is of a configuration symmetrical about a longitundinal centerline of the blank whereby the packet is formed by folding the blank in a symmetrical manner in relation to said longitudinal centerline of said blank;

wherein front and side walls of said first lid are provided by panels of said blank which in said blank are other than in abutting attachment to body panels of said blank, whereas front and side walls of said second lid are provided by panels which in said blank abut and are attached along lines of weakness to body panels of said blank, whereby the first opening of said second lid is accomplished by separation of the respective lid and body panels along said lines of weakness.

19. The packet according to claim 18 further comprising first and second neck inserts, each received in said body, said first insert extending from said body and being received into said first lid when said first lid is in the closed position thereof, and said second insert extending from said body and being received into said second lid when said second lid is in the closed position thereof.

20. The packet according to claim 14 in which the portion of each of said inserts which extends from said body comprises a cigarette access cutout, the cutout of said first insert being located to one side of said packet and the cutout of said second insert being located to the other side of the packet.

* * * * *